US006616223B1

(12) United States Patent
Lin

(10) Patent No.: US 6,616,223 B1
(45) Date of Patent: Sep. 9, 2003

(54) FOLDABLE CHAIR

(75) Inventor: Wen-Shen Lin, Kaohsiung (TW)

(73) Assignee: Maxchief Investments Ltd., Hong Kong (HK)

( * ) Notice: Subject to any disclaimer, the term of this patent is extended or adjusted under 35 U.S.C. 154(b) by 0 days.

(21) Appl. No.: 10/093,556

(22) Filed: Mar. 7, 2002

(51) Int. Cl.[7] ..... A47C 4/00

(52) U.S. Cl. ..... 297/55; 297/58; 297/56; 297/16.1

(58) Field of Search ..... 297/55, 58, 54, 297/452.18, 451.11, 452.2, 452.21, 23, 16.1

(56) References Cited

U.S. PATENT DOCUMENTS 1,873,768 A * 8/1932 Kux ..... 297/56
2,364,647 A * 12/1944 O'Connor ..... 297/452
2,729,275 A * 1/1956 Morgan et al. ..... 297/58
3,498,668 A * 3/1970 Vanderminden, III ..... 168/2
3,977,721 A * 8/1976 Peterson ..... 297/45
4,526,423 A * 7/1985 Meinershagen et al. ..... 297/452.18
5,655,815 A * 8/1997 Lohmeyer ..... 297/452.2
5,735,572 A * 4/1998 Clark et al. ..... 297/216.13
5,868,469 A * 2/1999 Ming ..... 297/338
6,250,718 B1 * 6/2001 Newhouse et al. ..... 297/452.1

* cited by examiner

*Primary Examiner*—Peter M. Cuomo
*Assistant Examiner*—Stephanie Harris
(74) *Attorney, Agent, or Firm*—Alan D. Kamrath; Rider Bennett, LLP

(57) ABSTRACT

A foldable chair has a plastics seat pad, a plastics backrest, and a chair frame having a pair of metal front leg tubes and a pair of metal rear leg tubes. Each metal front leg tube and the corresponding metal rear leg tube are connected together. The plastics backrest has two lateral posts inserted in the metal front leg tubes. A support bar has two positioning ends connected to the metal front leg tubes. Two U-shaped frames are disposed on two positioning ends of the support bar. Each U-shaped frame is connected to the corresponding metal front leg tube and the corresponding metal rear leg tube. Each metal front leg tube has a blocking bar to block the plastics backrest.

2 Claims, 6 Drawing Sheets

FOLDABLE CHAIR

BACKGROUND OF THE INVENTION

The present invention relates to a foldable chair. More particularly, the present invention relates to a foldable chair which has a light weight.

A conventional foldable chair is made of metal. However, the metal chair is very heavy. Another conventional foldable chair is made of plastics. However, the plastics chair is not durable.

SUMMARY OF THE INVENTION

An object of the present invention is to provide a foldable chair which has a plastics seat pad and a plastics backrest to reduce a weight of the foldable chair.

Another object of the present invention is to provide a foldable chair which is durable after a long period of usage.

Accordingly, a foldable chair comprises a plastics seat pad, a plastics backrest, and a chair frame having a pair of metal front leg tubes and a pair of metal rear leg tubes. Each of the metal front leg tubes and the corresponding metal rear leg tube are connected together. The plastics backrest has two lateral posts inserted in the metal front leg tubes. A support bar has two positioning ends connected to the metal front leg tubes. Two U-shaped frames are disposed on two positioning ends of the support bar. Each of the U-shaped frames is connected to the corresponding metal front leg tube and the corresponding metal rear leg tube. Each of the metal front leg tubes has a blocking bar to block the plastics backrest.

DETAILED DESCRIPTION OF THE INVENTION

Figure 1:
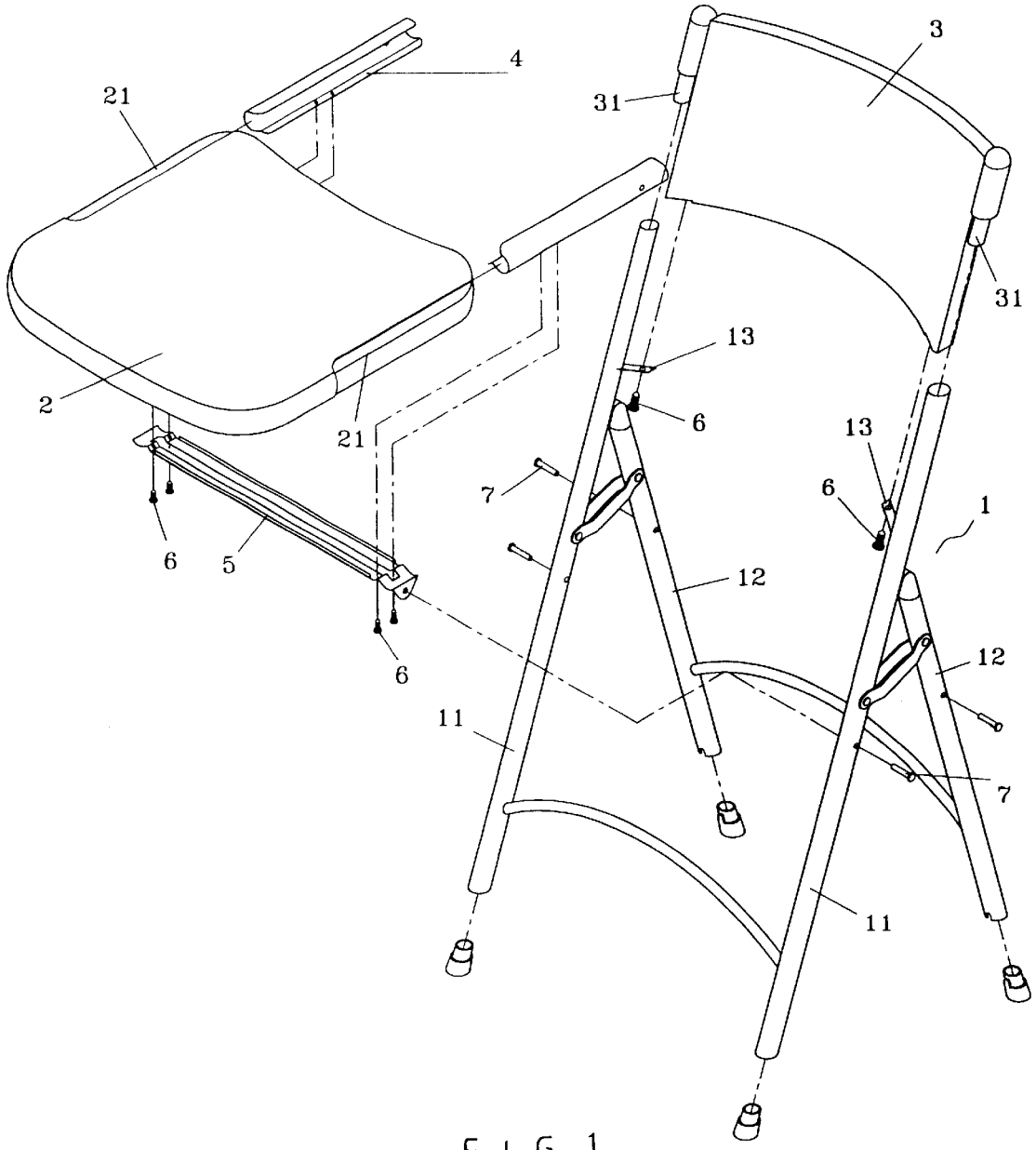
FIG. 1 is a perspective exploded view of a foldable chair of a preferred embodiment in accordance with the present invention.
Figure 2:
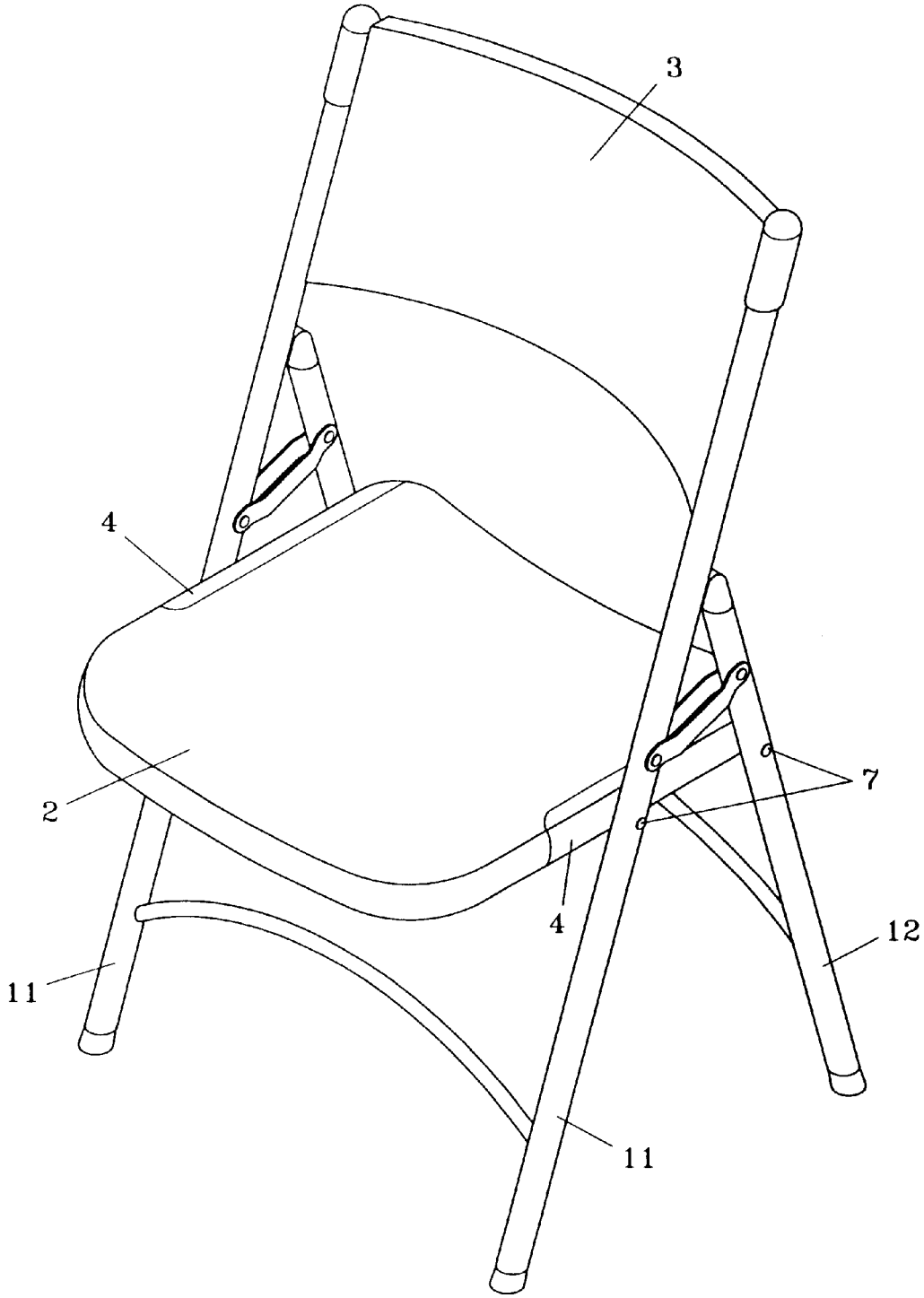
FIG. 2 is a perspective assembly view of a foldable chair of a preferred embodiment in accordance with the present invention.
Figure 3:
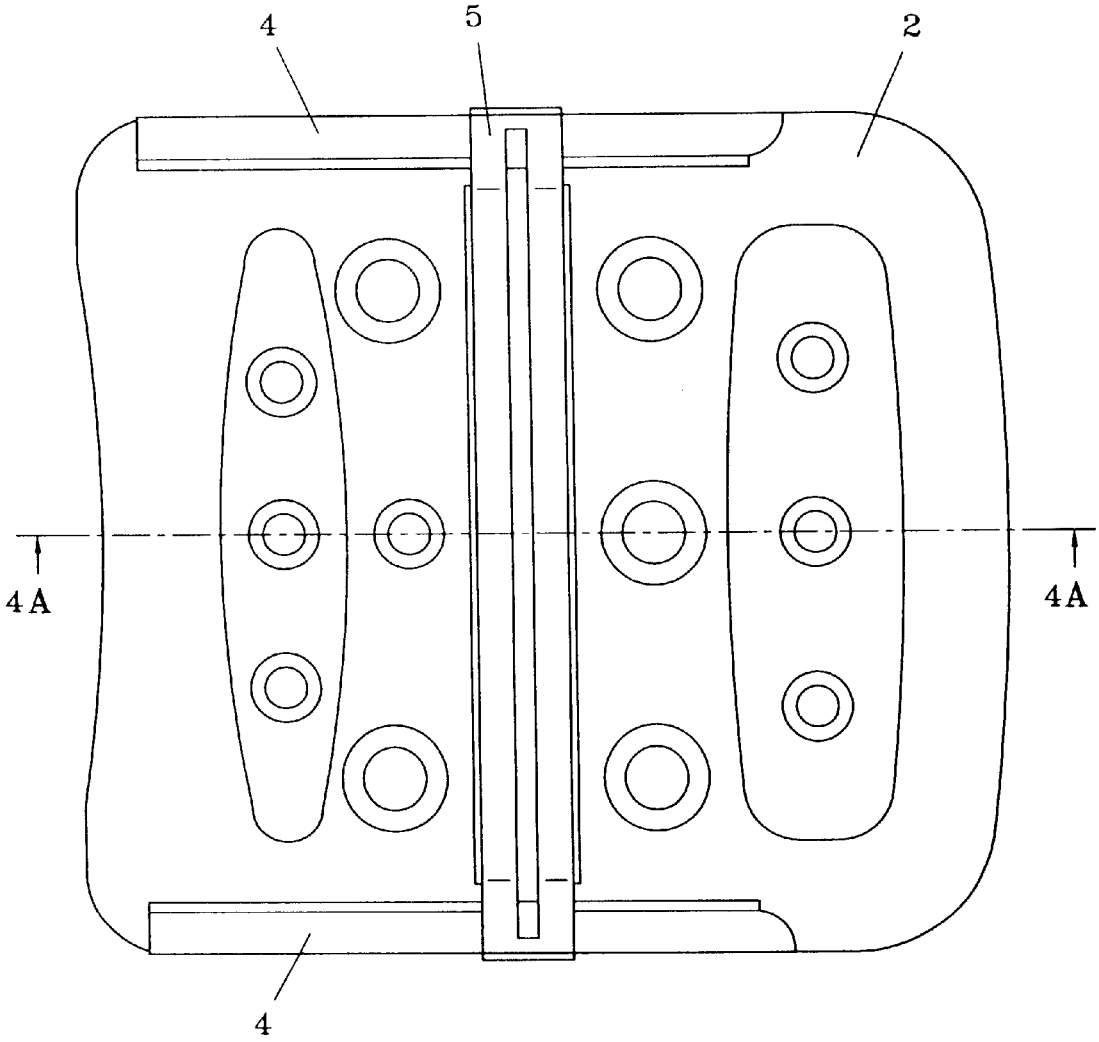
FIG. 3 is a bottom plan view of a plastics seat pad of a preferred embodiment in accordance with the present invention.
Figure 4:
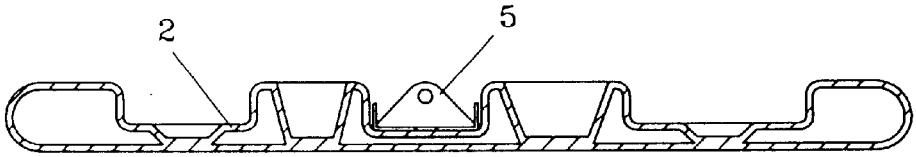
FIG. 4 is a sectional view taken along line 4A—4A in FIG. 3.
Figure 5:
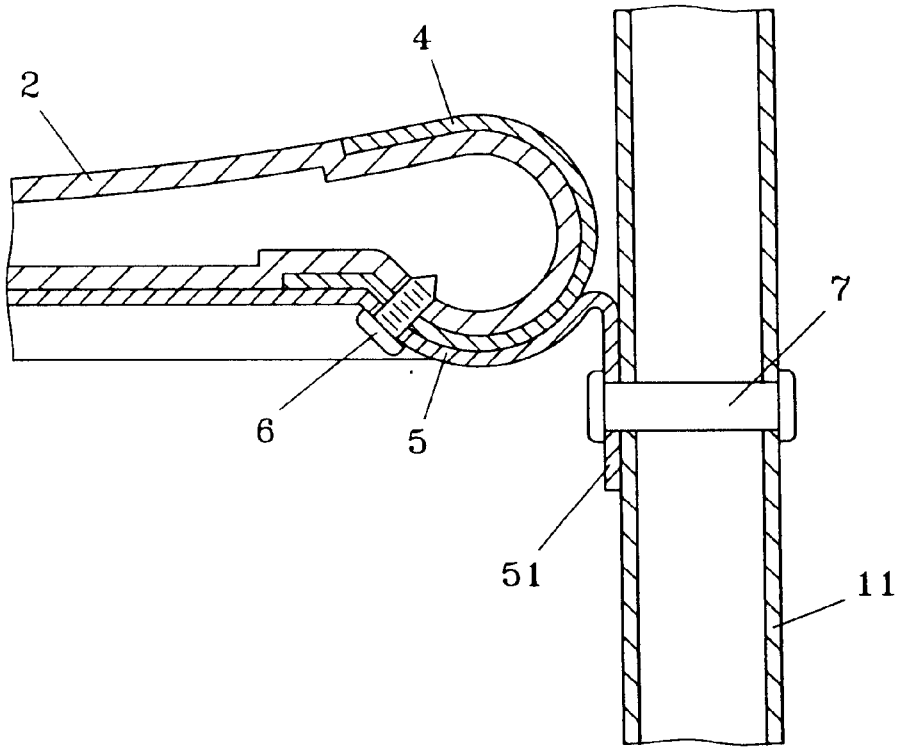
FIG. 5 is a sectional schematic view illustrating a support bar connected to a plastics seat pad and a metal front leg tube.
Figure 6:
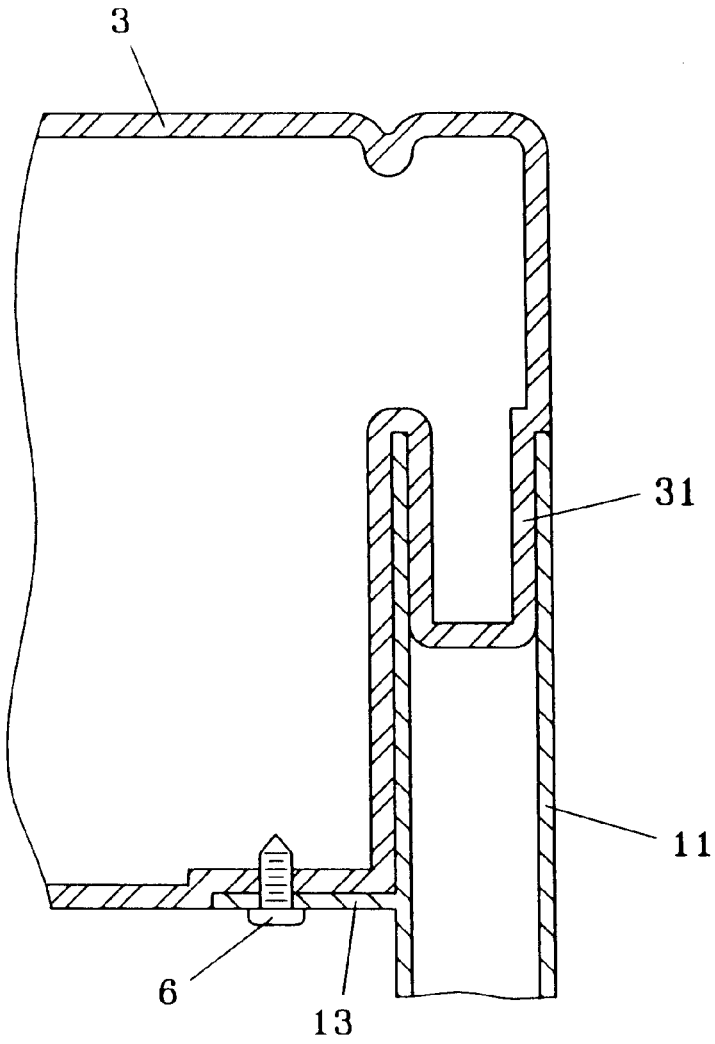
FIG. 6 is a sectional schematic view illustrating a plastics backrest connected to a metal front leg tube.
Figure 7:
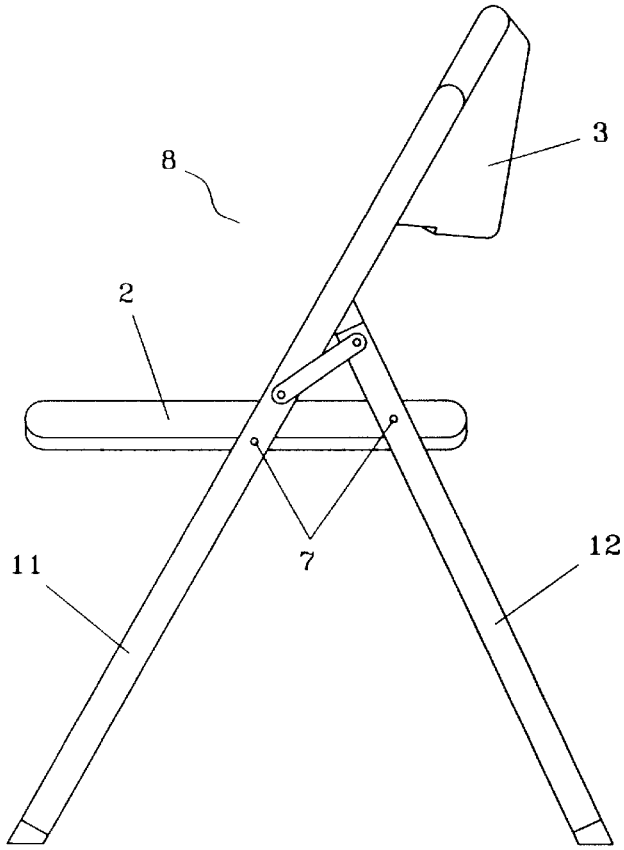
FIG. 7 is a schematic view illustrating a foldable chair of a preferred embodiment is extended.
Figure 8:
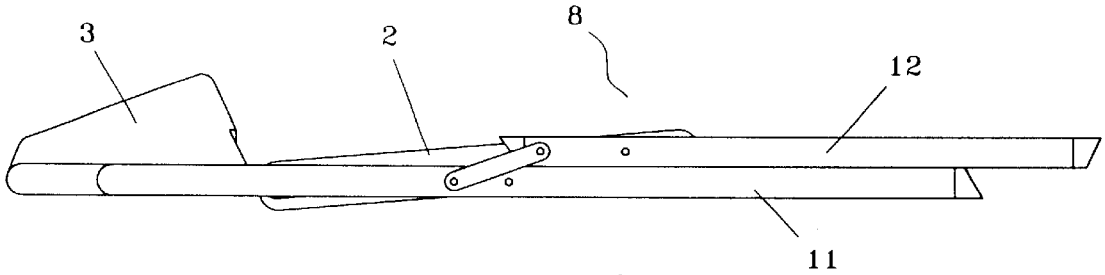
FIG. 8 is a schematic view illustrating a foldable chair of a preferred embodiment is folded.

Referring to FIGS. 1 to 8, a foldable chair 8 comprises a plastics seat pad 2, a plastics backrest 3, and a chair frame

1 having a pair of metal front leg tubes 11 and a pair of metal rear leg tubes 12.

Each of the metal front leg tubes 11 and the corresponding metal rear leg tube 12 are connected together.

The plastics backrest 3 has two lateral posts 31 inserted in the metal front leg tubes 11.

A support bar 5 has two positioning ends 51 connected to the metal front leg tubes 11.

Two U-shaped frames 4 are disposed on two positioning ends 51 of the support bar 5.

Each of the U-shaped frames 4 is connected to the corresponding metal front leg tube 11 and the corresponding metal rear leg tube 12.

A plurality of rivets 7 fasten each of the U-shaped frames 4 on the corresponding metal rear leg tube 12 and the support bar 5 on the corresponding metal front leg tube 11.

Each of the metal front leg tubes 11 has a blocking bar 13 to block the plastics backrest 3.

A plurality of fastening members 6 fasten the support bar 5 and the plastics seat pad 2 together and the blocking bar 13 and the plastics backrest 3 together.

The plastics seat pad 2 has a pair of lateral recesses 21 to receive the U-shaped frames 4.

The present invention is not limited to the above embodiment but various modification thereof may be made. Furthermore, various changes in form and detail may be made without departing from the scope of the present invention.

I claim:

1. A foldable chair comprises:

a plastics seat pad, a plastics backrest, and a chair frame having a pair of metal front leg tubes and a pair of metal rear leg tubes, each of the metal front leg tubes being connected to the corresponding metal rear leg tube, the plastics backrest having two lateral posts each inserted into a corresponding one of the metal front leg tubes, a support bar having two arcuate positioning ends each secured to a corresponding one of the metal front leg tubes, two U-shaped frames each secured on a corresponding one of the two positioning ends of the support bar, each of the U-shaped frames being connected to the corresponding metal front leg tube and the corresponding metal rear leg tube, and each of the metal front leg tubes having a blocking bar rested on a bottom of the plastics backrest to block the plastics backrest.

2. The foldable chair as claimed in claim 1, wherein the plastics seat pad has a pair of lateral recesses to receive the U-shaped frames.

* * * * *